United States Patent [19]

Biesanz, Sr.

[11] 4,364,213

[45] Dec. 21, 1982

[54] COMPOSITE BUILDING PANEL

[75] Inventor: Charles W. Biesanz, Sr., Winona, Minn.

[73] Assignee: Tru-Split Tool Company, Winona, Minn.

[21] Appl. No.: 180,404

[22] Filed: Aug. 22, 1980

[51] Int. Cl.[3] ..... E04C 1/00

[52] U.S. Cl. ..... 52/309.17; 52/483

[58] Field of Search ..... 52/309.13–309.17, 52/309.7, 483, 744, 390, 782

[56] References Cited

U.S. PATENT DOCUMENTS

| | | | |
|---|---|---|---|
| 2,718,829 | 9/1955 | Seymour et al. | 52/309.17 X |
| 3,350,048 | 8/1967 | Morain | 52/390 X |
| 3,965,635 | 6/1976 | Renkert | 52/309.7 X |
| 4,045,933 | 9/1977 | Grillo | 52/483 X |
| 4,245,444 | 1/1981 | Hicks | 52/309.17 X |

*Primary Examiner*—J. Karl Bell

*Attorney, Agent, or Firm*—Diller, Ramik & Wight

[57] ABSTRACT

This disclosure relates to a novel composite building panel formed as a plurality of generally flat exterior elements defining gaps therebetween and being in generally coplanar relative relationship, adhesive means for at least in part filling the gaps and at least in part covering inner surfaces of the elements, a generally planar sheet of plastic material overlying the plurality of elements and being bonded thereto by the adhesive, a support frame, and connectors for connecting at least one of the elements and the plastic sheet to the support frame for utilization in a building structure.

25 Claims, 21 Drawing Figures

COMPOSITE BUILDING PANEL

This invention relates to a novel composite building panel formed from a plurality of generally flat exterior elements (natural stone) disposed in generally coplanar relative relationship with each element being defined by inner, outer and peripheral surfaces, the peripheral surfaces being disposed in spaced relationship to define gaps therebetween, an adhesive for at least partially filling the gaps and at least in part covering inner surfaces of the elements, a generally planar sheet of plastic material overlying the plurality of elements and being bonded thereto by the adhesive, a support frame, and means for connecting the elements and the plastic sheet to the support frame.

Another object of this invention is to provide a novel composite building panel of the type defined wherein the connecting means include a plurality of studs bonded by the adhesive means to at least one of the elements.

Still another object of this invention is to provide a novel composite building panel of the type set forth immediately heretofore, wherein the support frame includes an opening for receiving each stud and the connecting means further includes a fastener connected to each stud to connect the support frame to the plastic material and to the plurality of elements.

Still another object of this invention is to provide a novel composite building panel of the type set forth heretofore, wherein the connecting studs are each bonded by the adhesive means in a bore of selected ones of the elements.

In keeping with the foregoing, a further object of this invention is to provide a novel method of forming a composite building panel of the type heretofore described including the steps of arranging a plurality of generally flat exterior elements, such as natural stone, in generally coplanar relative relationship and with peripheral surfaces of the elements spaced to define at least one gap therebetween, applying an adhesive upon an upper surface of the elements and within the gap, placing a sheet of plastic material atop the adhesive to bond the elements thereto, forming a bore in at least one of the elements and an opening in the plastic sheet generally coaxial with the bore, and adhesively bonding a stud within the bore in internal telescopic relationship to the opening.

Still another object of this invention is to provide a novel method as set forth heretofore, including the step of securing a support frame to the stud by utilizing a fastener.

Yet another object of this invention is to provide a novel method of the type described including the step of sanding the upper surfaces of the elements to a generally flat configuration before applying the adhesive thereon, and inserting caulking material in the gap before applying adhesive therein whereby the gap is only partially filled with the adhesive.

Still another object of this invention is to provide a novel method of forming a composite building panel as described herein, including the step of providing the support frame with at least one opening and forming the bore in the element and the opening in the plastic sheet by placing the support frame upon the plastic sheet, utilizing the support frame opening to locate the desired position of the bore of the element and the opening of the plastic sheet, and thereafter forming the latter bore and opening at the desired position by an appropriate drilling operation.

With the above and other objects in view that will hereinafter appear, the nature of the invention will be more clearly understood by reference to the following detailed description, the appended claims and the several views illustrated in the accompanying drawings.

In the drawings:

FIG. 1 is a fragmentary perspective view, and illustrates an initial step in the process of the present invention, namely, that of cutting a generally rectangular element from a piece of natural stone or the like.

Figure 12:
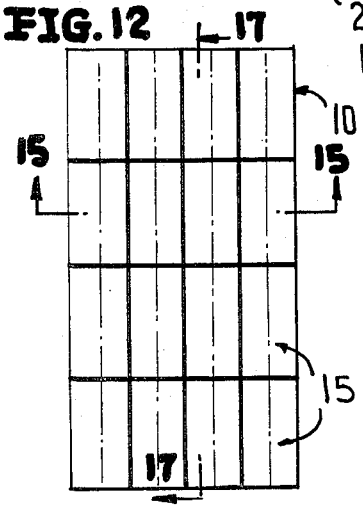
FIGS. 12 through 14 illustrate variations in the patterns of elements in the overall composite building panel.
Figure 13:
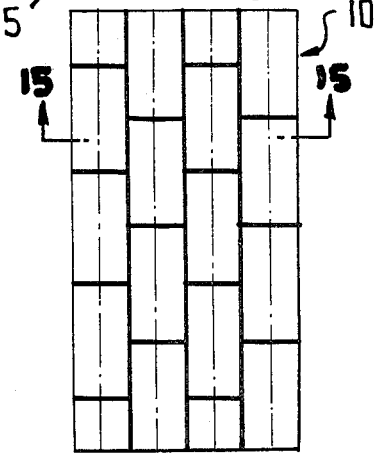
Figure 14:
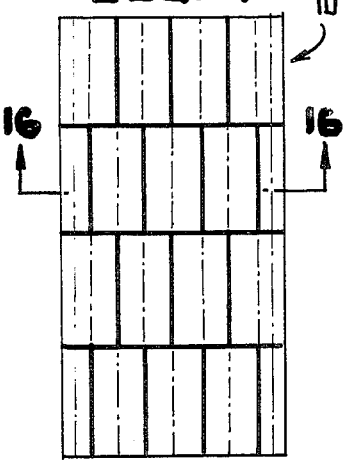
Figure 15:
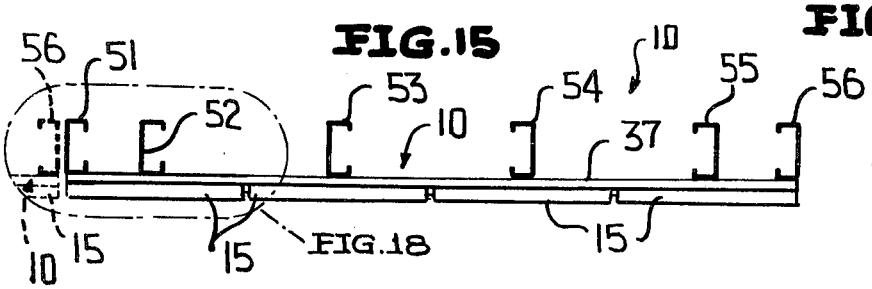
FIG. 15 is a cross-sectional view, slightly enlarged, taken generally along lines 15—15 of both FIGS. 12 and 13, and illustrates the manner in which metallic studs of the support frame are positioned upon the plastic sheet and the relationship thereto to the underlying elements (stone or stone facing).
Figure 16:
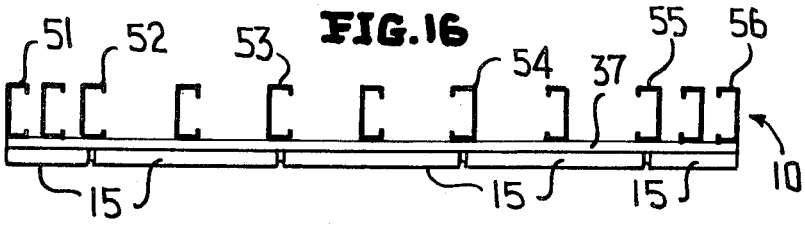

FIG. 16 is a cross-sectional view, again slightly enlarged, taken generally along lines 16—16 of FIG. 14, and likewise illustrates metallic studs of a support frame positioned atop a plastic sheet with the added studs, as compared to FIG. 15, being utilized to accommodate the staggered vertical joints of the composite panel of FIG. 14, as compared to the nonstaggered vertical joints of the panels of FIGS. 12 and 13.

Figure 17:
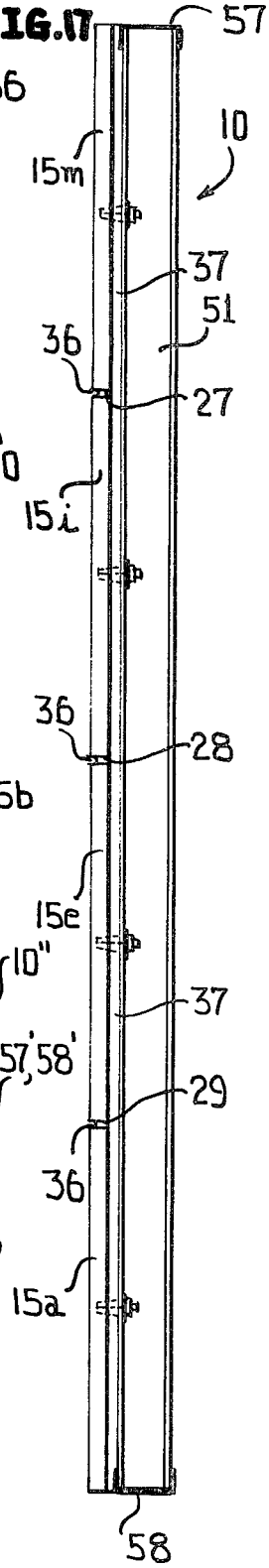

FIG. 17 is a side elevational view of a composite building panel, and illustrates the manner in which at least one stud is connected by adhesive to each element (stone facing) for securing the same to an associated metallic stud.

Figure 18:
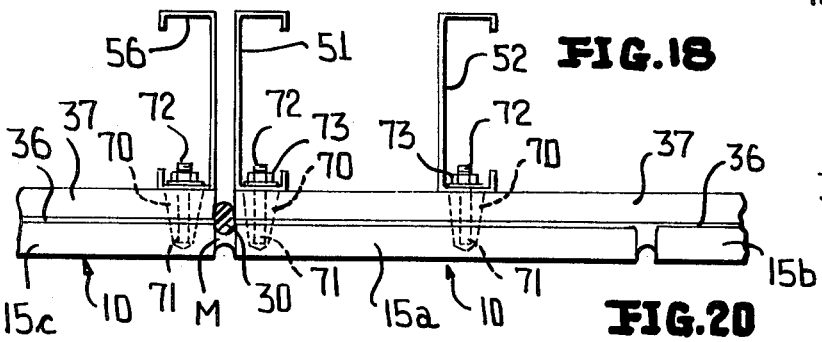

FIG. 18 is an enlarged sectional view taken through portions of two adjoining composite building panels of this invention, and illustrates the manner in which adjacent edges are field caulked.

Figure 19:
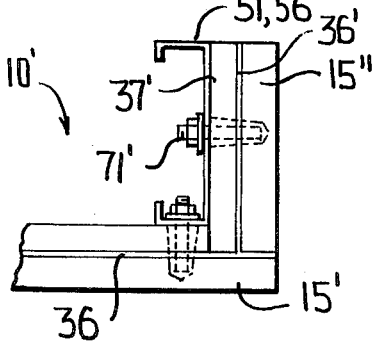

FIG. 19 is a fragmentary perspective view similar to FIG. 18 and illustrates a corner construction in which additional elements along endmost ones of the metallic studs are fastened thereto by appropriate fasteners.

Figure 20:
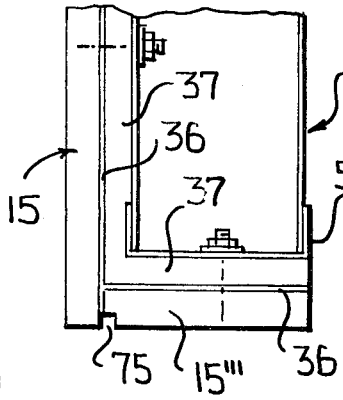

FIG. 20 is a fragmentary sectional view similar to FIG. 19, and illustrates a soffit detail of the invention, including a drip groove in one of a plurality of external elements.

Figure 21:
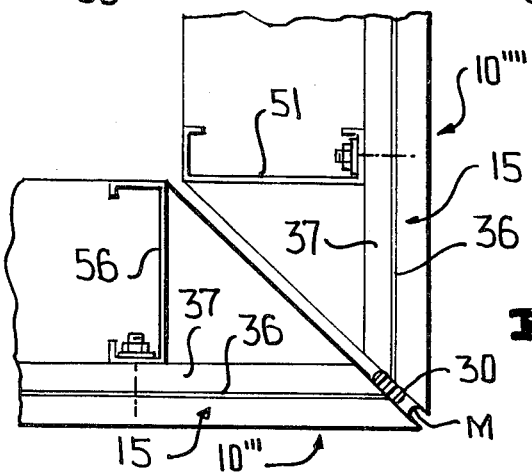

FIG. 21 is a fragmentary view similar to FIGS. 19 and 20, and illustrates another corner detail of the invention in which adjacent stone facings are cut at approximately a 45 degree angle to each other.

A novel composite building panel constructed in accordance with this invention is illustrated in FIGS. 10 and 12 through 21 of the drawings, and is generally designated by the reference numeral 10. The composite building panel 10 is manufactured by a novel method or process which will first be described in connection with FIGS. 1, 2, etc. of the drawings to which reference is now made.

Figure 1:
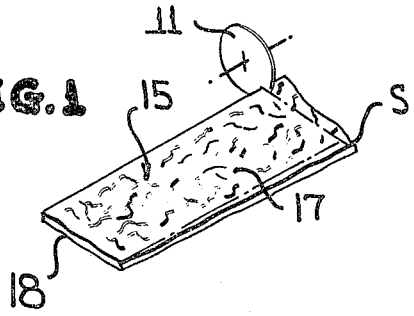
Figure 2:
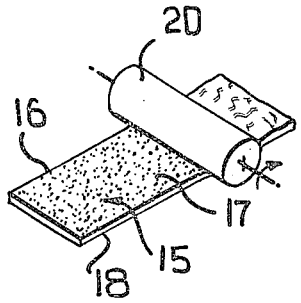
FIG. 2 is a perspective view of the element after being cut, and illustrates a grinding operation to smooth upper and lower surfaces of the element.

In FIG. 1 of the drawings, a slab S of natural stone, although the same might be artificial, is shown being cut by a saw 11 to a generally rectangular configuration to form a rectangular element or stone facing 15. The element or stone facing 15 includes a peripheral bounding edge 16, an upper surface 17, and a lower surface 18. Though only a single element 15 is shown being cut from the slab S, it is to be understood that a plurality of such elements 15 are formed and eventually each such element 15 is subjected to a grinding operation by a conventional abrading or grinding cylinder 20 which is rotated by conventional means (not shown) such that both surfaces 17 and 18 are rendered relatively smooth or plumb. Preferably the thickness of each element 15 at the end of the grinding operation is approximately 1 and 1¼ inch.

Figure 3:
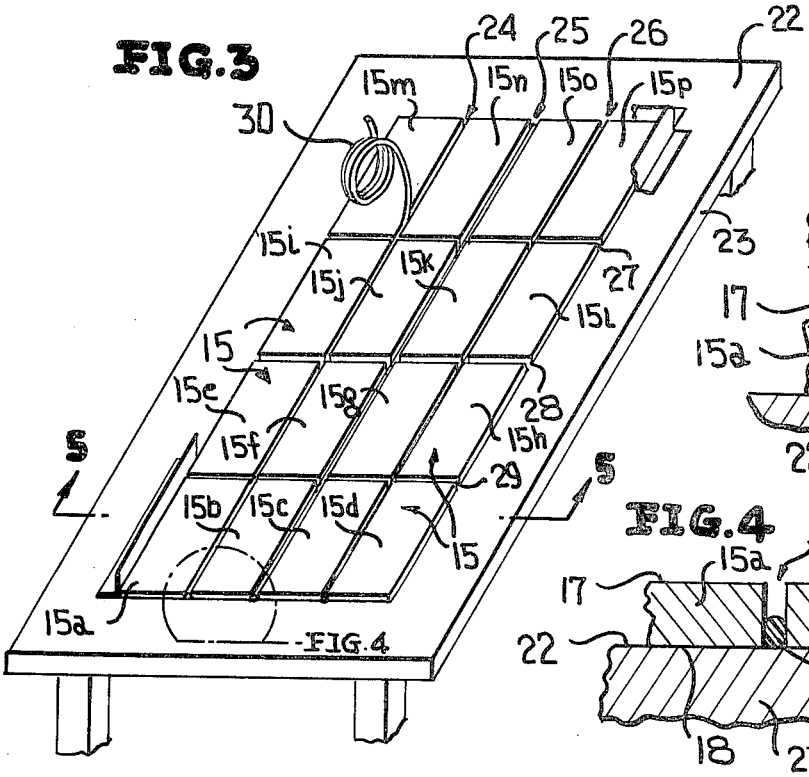
FIG. 3 is a fragmentary perspective view of a table, and illustrates a plurality of the elements ground in accordance with FIG. 1 and being positioned atop the table in a predetermined arrangement with gaps between the individual elements being filled by flexible caulking material.

After the individual stone facings or elements 15 have been ground (FIG. 2), a plurality of such elements 15 are positioned atop a relatively flat planar horizontal surface 22 of a table or suitable support 23, and for purposes of description the individual elements 15 in FIG. 3 have been provided with appropriate letters of the alphabet as subscripts to distinguish adjacent elements 15 one from the other. Thus, in FIG. 3 the fifteen elements are identified by the reference numerals 15*a* through 15*p* and all of the latter are spaced from each other to define therebetween a plurality of gaps or spaces 24 through 26 running vertically and like gaps or spaces 27 through 29 running horizontally. Once the individual elements 15*a* through 15*p* have been so positioned atop the surface 22 of the table 23, removable caulking material in the form of polystyrene caulking rope 30 is inserted in all of the gaps 24 through 29 in the manner best illustrated in FIG. 4 of the drawings. Thus, all of the gaps 24 through 29 are filled with the caulking rope 30 and each piece of caulking rope 30 is positioned so as to rest atop and against the surface 22 of the table 23 such that each gap 24 through 29 is sealed at its edge most adjacent the surface 18 of each element 15 and is opened adjacent each surface 17 of each element 15 with the surfaces 18, 17 being nominally described as the outer and inner surfaces, respectively, to designate the relationship of those surfaces to the exterior of an associated building, as will be more readily apparent hereinafter.

Figure 6:
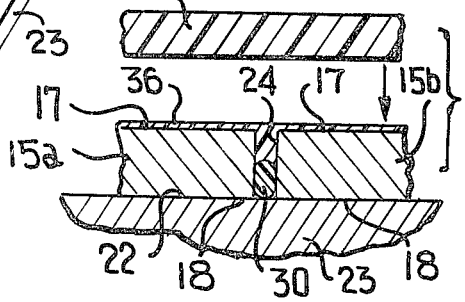
FIG. 6 is an enlarged fragmentary sectional view of the circled portion of FIG. 5, and illustrates the manner in which the adhesive is applied in a relatively thin film or coating to an inner surface of the elements and within the gap therebetween prior to the application of a sheet of plastic material thereatop.
Figure 4:
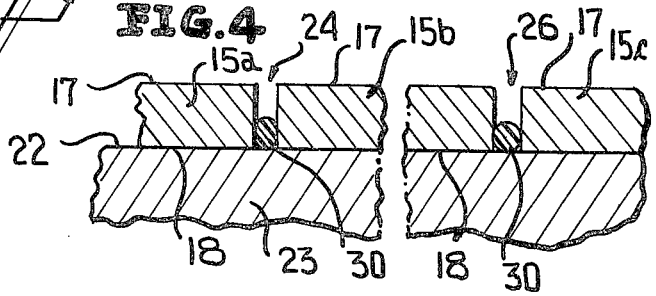
FIG. 4 is an enlarged fragmentary sectional view of the encircled portion of FIG. 3, and illustrates the caulking material disposed in gaps of adjoining elements.
Figure 5:
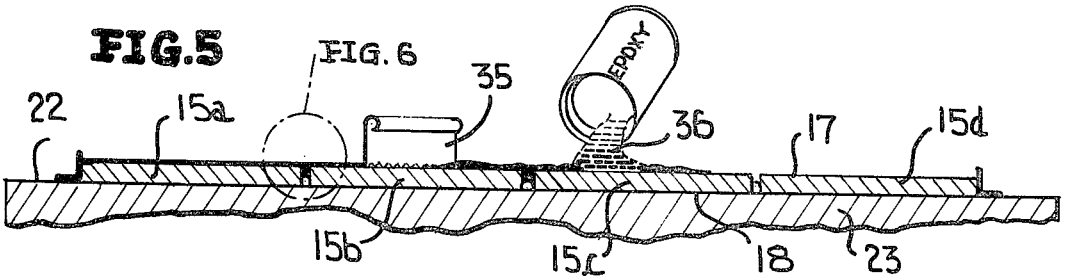
FIG. 5 is a fragmentary sectional view taken generally along line 5—5 of FIG. 3, and illustrates adhesive being applied atop an innermost surface of the elements and the manner in which a trowel is utilized for applying the adhesive thereto in a desired quantity.
Figure 7:
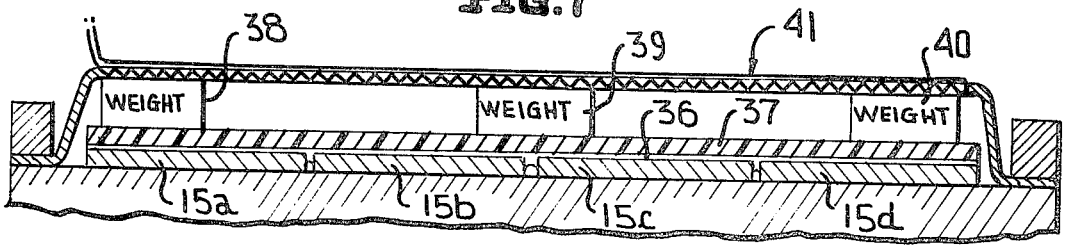
FIG. 7 is a sectional view similar to FIG. 5 and illustrates a plurality of weights positioned atop the plastic sheet and covered by a heating pad or the like to accelerate the curing of the adhesive.

After all of the gaps 24 through 29 have been temporarily caulked by the caulking rope 30 in the manner described relative to FIGS. 3 and 4, an appropriate epoxy resin adhesive 36 which is heat curable is poured or otherwise applied atop the surfaces 17 of all of the elements 15 and a uniform thickness is achieved by utilizing a trowel 35 which further flows the adhesive 36 into the gaps 24 through 29 and atop the caulking rope 30 in the manner best illustrated in FIG. 6. Once the adhesive 36 has been smoothed and leveled to a desired thickness and all of the gaps 24 through 29 have been filled therewith, a relatively thick sheet of styrofoam or like plastic material 37 corresponding in size to the overall outer peripheral dimension of the elements 15*a* through 15*p* is laid atop the adhesive 36 and, of course, in overlying relationship to all of the elements 15*a* through 15*p*, as is best illustrated in FIG. 7. One or more weights 38, 39, 40, etc. are then placed atop the styrofoam or like plastic sheet 37 to intimately urge the same into contact with the layer of adhesive 36 and, of course, urge the layer of adhesive 36 into intimate bonding relationship with all of the elements 15*a* through 15*p*. Furthermore, the weights 58 through 40 also prevent the styrofoam sheet 37 from twisting, warping or otherwise deflecting from its generally uniplanar position (FIG. 7) as might occur during the curing operation of the adhesive 36 which can occur under ambient temperature conditions, but the curing operation can be augmented or hastened by covering the entire assemblage in FIG. 7 with an electric resistance heating blanket 41 or simply subjecting the overall assemblage of FIG. 7 to a heat source, such as infrared lamps, a heating oven, etc. During this curing operation, the adhesive 36 cures or sets and intimately bonds all of the elements 15*a* through 15*p* to the single styrofoam sheet 37 but not to the caulking material or rope 30. Preferably, the adhesive 36 has little bonding affinity relative to the caulking rope 30 and after the adhesive 36 has cured, all of the caulking rope 30 is removed from the gaps 24 through 29 leaving partial gaps between adjacent elements as is best illustrated in FIG. 18 of the drawings.

The plurality of elements 15*a* through 15*q*, the adhesive 36, and the plastic sheet 37 form a subassembly which is generally designated by the reference numeral 45 (FIG. 8), and temporarily positioned thereatop is a support frame 50 formed of a plurality of individual metallic studs 51 through 56 disposed in generally parallel relationship to each other and secured at opposite ends to similar metallic studs 57, 58 thereby imparting a generally rectangular configuration to the support frame 50 whose outer periphery corresponds generally to the outer periphery of the subassembly 45. The U-shaped studs or beams 51 through 56 are provided with a plurality of openings 60 in the flanges (unnumbered) thereof, and the openings are so placed that at least one opening is in registration with each of the elements 15*a* through 15*p*. Like openings corresponding to the opening 16 might also be placed in the webs or flanges of the U-shaped studs or beams 57, 58. The frame 50 is then lowered upon the inside or interior surfaces 17 of the individual elements 15*a* through 15*p* and a pencil or like scribe is inserted through the openings 60 and a mark or marking 61, 62, etc. is made upon the exterior surface 17 of each of the elements 15*a* through 15*p*.

Thereafter, the support frame 50 is removed and a suitable tool (FIG. 9) such as a drill bit 63 is utilized to form an opening 64 through the plastic sheet 37 at each of the markings 61, 62, a like opening 65 through the adhesive thereof, and a blind bore 66 in each of the elements 15*a* through 15*p*. The drill bit 63 might be wobbled such that the overall cross-sectional configuration of the opening 64, the opening 65 and the blind bore 66 is of a generally frusto-conical configuration, as is most readily apparent in FIG. 10. Once such a frusto-conical opening 64, 65, 66 is formed at each of the markings 61, 62, adhesive means 70, such as an epoxy adhesive, is poured into the bores 64, 65 and 66 after which a stud 71 having a threaded end portion 72 is positioned within each bore and within the adhesive therein, as is clearly apparent from FIG. 10 of the drawings. The support frame 50 is then lowered upon the plastic material 37 and each threaded end portion 72 of an associated stud 71 is located in one of the openings 60 of the beams or studs 51 through 56. The openings 60 serve to hold the studs 71 in alignment during the curing or solidifying of the adhesive 70 after which a washer 74 is inserted upon the threaded end portion 72 of the studs 71 and, finally, a nut 73 is threaded and tightened to connect the support frame 50 to each of the individual elements 15*a* through 15*p* through the studs 71 associated with each. This completes the formation of the overall composite building panel which is generally designated by the reference numeral 10 except that the same type of epoxy 70 might be utilized to cover the tightened nut 73 and the exposed end of the end portion 72 to hold these elements in their locked position during travel, building assembly, etc. From the latter description, it will be noted that each of the individual composite building panels is made up of fifteen individual stone facings or elements 15*a* through 15*p*, but all of these are rigidly interconnected to the support frame 50 through the studs 71 and the adhesive 70 while the plastic sheet material 37 functions as insulation for heat, cold, fire, sound, etc. The composite building panel 75 may then be assembled along the exterior face of the building and secured thereto in a conventional manner through the support frame 50 with the overall size, shape, etc. of the individual composite building panels 10 being variable to suit conditions, building codes and characteristics, architects and builders desires, etc.

Figure 8:
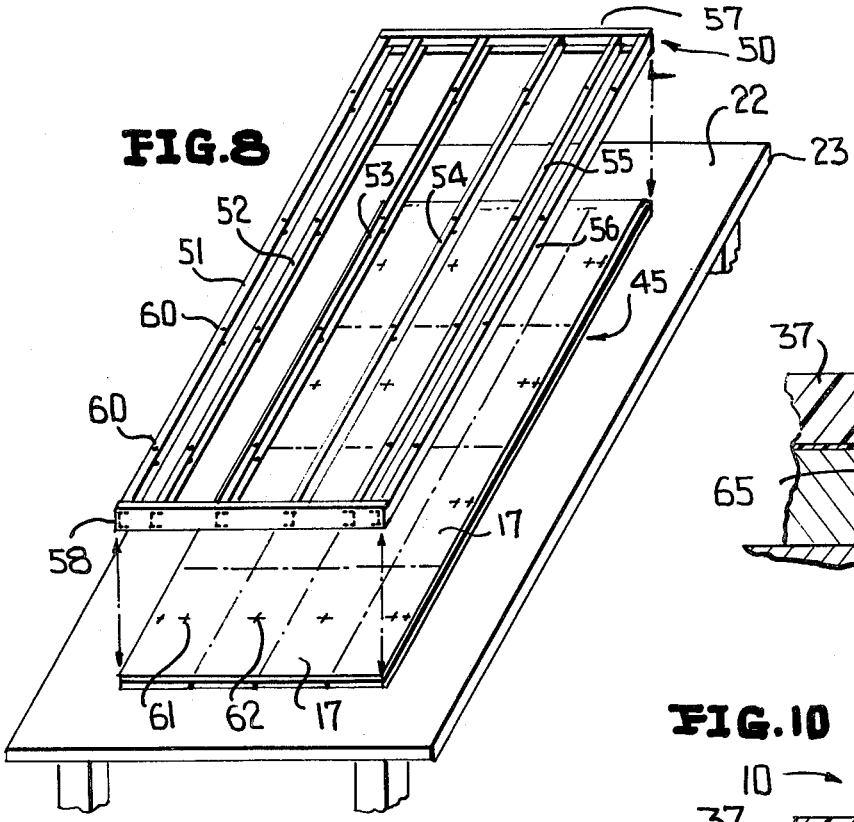
FIG. 8 is a perspective view of the partially completed composite building panel of FIG. 7 after the weights and heating panel have been removed, and illustrates a supporting frame having openings which are utilized to mark the plastic sheet for the eventual formation therein of openings therein and coaxial bores in the elements.

The composite building panels 10 may be configured with its individual elements 15 in a regular nonstaggered relationship, in the manner heretofore described relative to FIG. 8 and as best shown in FIG. 12 or the same elements 15 might be staggered, as shown in FIG. 13. The composite building panels 10 of FIGS. 12 and 13 are not staggered along vertical lines but are staggered along horizontal lines, but in each case the support frame 50 associated therewith need but utilize six of the parallel C-shaped studs or beams 51 through 56. However, if the elements are staggered horizontally relative to each other, as illustrated in FIG. 14 relative to the composite building panel 10 thereof, it is necessary to include additional C-shaped beams or studs, in the manner best indicated in FIG. 16, so that each of the elements 15 is bolted to at least one of the C-shaped studs or beams in the manner most readily apparent from FIG. 16.

FIGS. 17 and 18 depict the composite panels 10 as they would be mounted to a building to form the exterior facing thereof, and when two of such composite building panels 10 are connected end-to-end, as shown in FIG. 18, caulking rope 30 of polystyrene is inserted between the adjacent spaced edges at the building site during installation, and thereafter conventional caulking material M is injected in the space so that when viewed from the exterior, one can not determine where one building panel ends and the other begins.

Reference is now made to FIG. 19 which shows a slightly modified version of the composite building panel heretofore described in which each element 15' along both longitudinal edges projects beyond an associated one of the U-shaped studs, channels or beams 51' or 56' and connected to the latter in the manner heretofore described is a sheet of insulating material 37', one or more additional elements or stone facings 15'' and adhesive 36' therebetween with the usual connecting studs 71'. This construction provides an overall composite building panel 10' which can be located at the door, window, or the like to effect a smooth, unbroken and esthetically acceptable corner.

The composite building panel 10'' of FIG. 20 is similar to the composite building panel 10' of FIG. 19 except that one or more facing elements, stone facings, or like elements 15''' are slotted as at 75 to provide a drip or drain opening, and these are bolted by the studs and adhesive heretofore noted to one of the upper or lower U-shaped studs or beams 57', 58' corresponding to the U-shaped studs or beams 57, 58 of the composite panel 10. Thus, the construction of the composite building panel 10' of FIG. 2 permits the elements or stone facing 15''' to be disposed along either of the shorter lengths or U-shaped channels 57, 58 or 57', 58', whereas in FIG. 19 the composite building panel 10' has the additional elements or stone facings 15'' running along the length of the channels 51 or 56.

A composite building panel 10''' of FIG. 21 is similar to the panel 10 except that the associated corresponding plastic sheet material 37, adhesive 36, and endmost elements or stone facings 15 project beyond the individual longitudinal edges of the composite building panels 10''', 10'''' and the terminal edges are cut at 45° angles and caulked in the manner described relative to FIG. 18.

Figure 9:
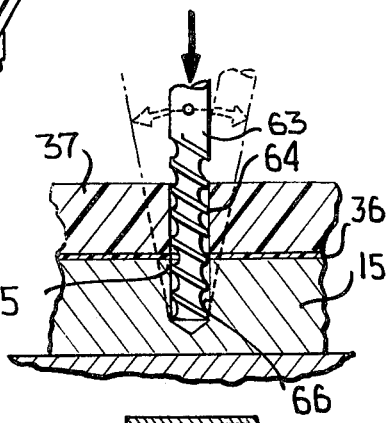
FIG. 9 is an enlarged fragmentary sectional view of a portion of the panel of FIG. 8, and illustrates the manner in which a drill is utilized to form an opening in the plastic sheet and a bore in an underlying one of the plurality of elements.
Figure 10:
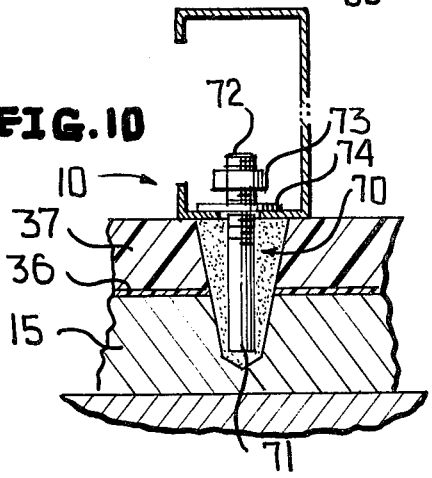
FIG. 10 is a fragmentary sectional view similar to FIG. 9, and illustrates the frame in position atop the panel, a stud received in the opening and bore, and adhesive within the bore to bind the stud within the bore of the element and the opening of the plastic material.
Figure 11:
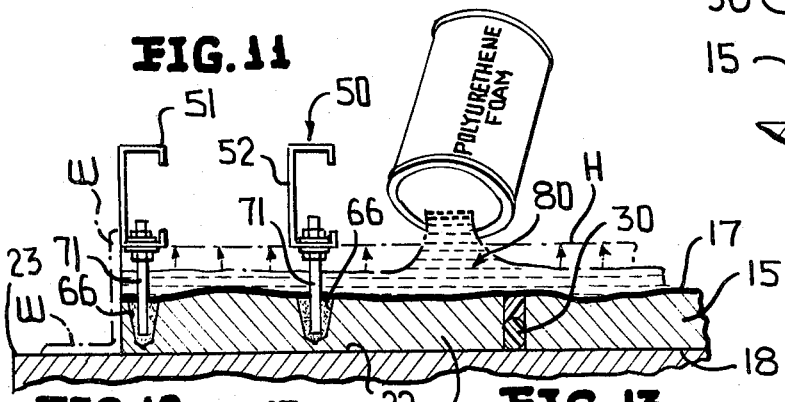
FIG. 11 is an enlarged sectional view similar to FIG. 5, and illustrates a plurality of elements of which only one surface has been surface ground to a flat configuration while a rougher unground surface has applied thereto a polyurethane foam (adhesive) for uniting or bonding a frame to associated studs received in bores of the individual elements.

Reference is made to FIG. 11 which shows the manner in which a composite building panel may be formed in the absence of (1) sanding the innermost surface 17 of each of the elements 15 and (2) in the absence of utilizing a separate sheet of plastic material, such as the plastic material 37. In this case because the surface 17 of the elements 15 are not gounded, they are not planar and thus have a generally irregular or undulating appearance, as is exaggerated in FIG. 11. However, bores corresponding to those designated by reference numeral 66 in FIG. 9 are formed in all of the elements 15 of FIG. 11, studs are placed therein after being connected to an associated frame 50, and the latter is supported in spaced relationship above the individual elements 15 by a suitable frame, support, or simply by the fact that the individual studs 71 rest against the bottom of the blind bores 66. The adjoining elements 15 are, of course, caulked with the usual caulking rope 30, as was heretofore described relative to FIG. 3. Thereafter, polyurethane foam 80 is poured atop the subassembly which, of course, is located in a peripheral reservoir or wall W to preclude the polyurethane foam 80 from flowing over the sides in an indiscriminate fashion. The polyurethane foam 80 is poured atop the individual elements 15 to a predetermined height H which, of course, also fills the gaps between the elements 15, and once the polyurethane foam 80 cures or solidifies, the entire composite building panel may be utilized in much the same manner as that heretofore described relative to the panels 10, 10', etc.

The various perimeters relative to the manufacture and the eventual product are variable, but preferably the individual panels 10, 10', etc. are made in convenient sizes up to, though not limited to, 10'×24'. The individual elements 15 are preferably ground to a standard 1¼' thickness and, though preferably constructed from natural stone, the weight is approximately only 15 lb. per sq. ft., the depth of the blind bore 66 in the elements 15 is approximately ¾" and the individual studs 71 are generally ⅜" bolts. Obviously, in any of these composite panels 10, 10', etc., the plastic material 37 and/or the poured polyurethane foam 80 are preferably approximately 1" thick. The gaps or spaces 24 through 29 can vary approximately between ⅛" to ½" and though the sizes of the individual elements 15 may vary, in an 8'×1' composite building panel 10, the individual elements or stone facings were 24"×48".

Although only a preferred embodiment of the invention has been specifically illustrated and described herein, it is to be understood that minor variations may be made in the apparatus without departing from the spirit and scope of the invention, as defined in the appended claims.

I claim:

1. A composite building panel comprising a plurality of generally flat exterior elements disposed in generally coplanar relative relationship, said elements each being defined by inner, outer and peripheral surfaces, at least some of said peripheral surfaces of some of said elements being disposed in spaced relationship to define gaps therebetween, adhesive means for at least in part filling said gaps and at least in part covering said inner surfaces, a generally planar sheet of plastic material overlying said plurality of elements and said adhesive means and being bonded to said plurality of elements by said adhesive means, means for defining a support frame, said support frame being in overlying relationship to said sheet of plastic material, and means passing through said sheet of plastic material for connecting at least one of said elements and said plastic sheet to said support frame.

2. The composite building panel as defined in claim 1 wherein said connecting means includes a stud.

3. The composite building panel as defined in claim 1 wherein said connecting means includes a stud bonded by said adhesive means to said at least one element.

4. The composite building panel as defined in claim 1 wherein said connecting means includes a stud bonded by said adhesive means to said plastic sheet.

5. The composite building panel as defined in claim 1 wherein said connecting means includes a stud bonded by said adhesive means to both said at least one element and said plastic sheet.

6. The composite building panel as defined in claim 3 wherein said support frame includes an opening receiving said stud, and said connecting means further includes a fastener connected to said stud.

7. The composite building panel as defined in claim 3 wherein said connecting stud is bonded by said adhesive means in a bore of said at least one element.

8. The composite building panel as defined in claim 3 wherein said connecting stud is bonded by said adhesive means in an opening of said plastic sheet.

9. The composite building panel as defined in claim 3 wherein said connecting stud is bonded by said adhesive means in a bore of said at least one element, said frame includes an opening receiving said stud, and said connecting means further includes a fastener connected to said stud.

10. The composite building panel as defined in claim 4 wherein said support frame includes an opening receiving said stud, and said connecting means further includes a fastener connected to said stud.

11. The composite building panel as defined in claim 5 wherein said connecting stud is bonded by said adhesive means in a bore of said at least one element.

12. The composite building panel as defined in claim 5 wherein said connecting stud is bonded by said adhesive means in an opening of said plastic sheet.

13. The composite building panel as defined in claim 11 wherein said support frame includes an opening receiving said stud, and said connecting means further includes a fastener connected to said stud.

14. The composite building panel as defined in claim 12 wherein said support frame includes an opening receiving said stud, and said connecting means further includes a fastener connected to said stud.

15. The composite building panel as defined in claim 1 wherein said inner surfaces are of irregular contours, said adhesive means has inner and outer surfaces, said adhesive means inner surface matches in mirror-image fashion said flat exterior elements inner surfaces irregular contours, and said adhesive means outer surface is generally uniplanar.

16. The composite building panel as defined in claim 15 wherein said flat exterior elements outer surfaces are generally uniplanar.

17. A method of forming a composite building panel comprising the steps of arranging a plurality of generally flat exterior elements in generally coplanar relative relationship and with peripheral surfaces of the elements spaced to define at least one gap therebetween, inserting a flexible strip of material in the gap, applying an adhesive which is adhesively incompatible with the flexible strip and adhesively compatible with the elements upon an upper surface of the elements, within the gap and upon the flexible strip, placing a sheet of plastic material atop the adhesive to bond the elements thereto, forming a bore in at least one of the elements and an opening in the plastic sheet generally coaxial with the bore, adhesively bonding a stud within the bore in internal telescopic relationship to the opening, and after the adhesive has set removing the flexible strip from the gap.

18. The method as defined in claim 17 including the step of exerting a force against the plastic sheet while the adhesive sets and thus bonds the plastic sheets to the exterior elements and prior to the performance of the bore forming and stud bonding steps.

19. The method as defined in claim 18 including the step of terminating the force exerting step and only thereafter performing the bore forming and stud bonding steps.

20. The method as defined in claim 17 including the step of securing a support frame to the stud by utilizing a fastener.

21. The method as defined in claim 17 including the step of sanding the upper surfaces generally flat before applying the adhesive thereon.

22. The method as defined in claim 17 including the step of providing a support frame having at least one opening therein and forming the element bore and plastic sheet opening by first placing the support frame upon the plastic sheet, utilizing the support frame opening to locate the desired position of the element bore and the plastic sheet opening, and thereafter forming the latter bore and opening at the desired position.

23. The method as defined in claim 17 including the step of providing a support frame having at least one opening therein, and forming the element bore and plastic sheet opening by first placing the support frame upon the plastic sheet, utilizing the support frame opening to locate the desired position of the element bore and the plastic sheet opening, and thereafter forming the latter bore and opening at the desired position by drilling through the plastic sheet to form the opening therein and drilling partially into the element to form the bore therein.

24. The method as defined in claim 18 wherein the stud is a threaded bolt and the fastener is a threaded nut.

25. The method as defined in claim 18 including the step of sanding the upper surface generally flat before applying the adhesive thereon.

* * * * *